US005142262A

United States Patent [19]

Onken

[11] Patent Number: 5,142,262

[45] Date of Patent: Aug. 25, 1992

[54] SLOW BLOWING CARTRIDGE FUSE AND METHOD OF MAKING THE SAME

[75] Inventor: Daniel Onken, Centralia, Ill.

[73] Assignee: Littelfuse, Inc., Des Plaines, Ill.

[21] Appl. No.: 719,734

[22] Filed: Jun. 24, 1991

[51] Int. Cl.[5] ..... H01H 85/04

[52] U.S. Cl. ..... 337/163; 337/228; 29/623

[58] Field of Search ..... 337/163, 164, 165, 166, 337/162, 161, 228; 29/623

[56] References Cited

U.S. PATENT DOCUMENTS 2,879,364 3/1959 Mucher ..... 337/208

4,409,729 10/1983 Shah ..... 29/623

4,460,887 7/1984 McAlear ..... 337/186

*Primary Examiner*—Harold Broome

[57] ABSTRACT

A slow blowing fuse includes an open-ended rigid housing defining a fuse element-containing space therein. Conductive end caps close off the ends of the housing and act as electric terminals for the fuse. A spiral wound fuse element in said space extends between the end caps. The spiral wound fuse element comprises a core of flexible material around which is spirally wound a fuse filament which is electrically connected to the end caps. The spiral wound fuse element is sandwiched between the end caps to provide a configuration where at least the central portion thereof is located adjacent to the housing walls.

12 Claims, 2 Drawing Sheets

SLOW BLOWING CARTRIDGE FUSE AND METHOD OF MAKING THE SAME

DESCRIPTION

Subject of the Invention

The present invention relates primarily to slow blowing miniature cartridge fuses and to a method of making them. By "slow blowing" is meant a fuse which will blow in not less than about 100 milliseconds under short circuit overload conditions. By miniature fuse is meant a fuse where the inside diameter of the housing is substantially less than 0.100", that is no greater than about 0.075". Cartridge fuses generally have cylindrical open-ended housings closed by cup-shaped end caps and fuse wire elements extending physically and electrically between bodies of solder in the end caps. Some aspects of the invention also have application to fast blowing fuses.

BACKGROUND OF THE INVENTION

The manufacture of slow blowing cartridge fuses in such a small inner housing space described above has, heretofore, caused design problems to obtain consistent opening results. Because of this difficulty, prior to the present time there have been no commercially available, reliable slow blowing miniature fuses.

Commercial miniature fuses heretofore have been fast acting fuses. They are constructed with fine straight wires extending diagonally across opposite ends of the housings. The fuse wire ends bend around the housing ends where they are received between the housing and cup-shaped end caps applied thereover. This places the center point of the fuse wires where they are expected to open in what was believed to be the most ideal position in the center of the housing. Unfortunately, under overloads which do not immediately open the fuse, the fine fuse wire sometimes undesirably heats, expands and sags to a point where the fuse wire comes close to or touches the housing walls. The heat sinking effect of the nearby fuse housing increases the circuit current which is needed to open the fuse.

The inventor of the present invention made substantial efforts to develop a slow blowing miniature fuse which could be efficiently mass produced; but he failed until the present invention was developed. Slow blowing fuse elements typically comprise a fine fuse wire spirally wound axially along a non-rigid, somewhat flexible and resilient core of insulating material. Such fuse elements typically extend axially rather than diagonally along the fuse housing. An effort was made to center the fuse element so that the fuse wire is as far as possible from the walls of the housing, in accordance with the generally understood desirable practice to do so. (See FIGS. 2 and 3 for examples of these initial, unsuccessful efforts to design a slow blowing fuse). The spacing of the fuse element wire from the housing walls used in these efforts was much greater than that used in the case of the centered spiral wound fuse element shown in FIG. 7 of U.S. Pat. No. 4,460,887, which is not drawn to scale. (The specification of this patent confirms that the spirally wound fuse element shown in this FIG. 7 is spaced from the housing walls by stating that the diameter of the centered fuse element 11 is less than the diameter of the housing space.)

These initial efforts to make a slow-blowing fuse using a centered spirally wound fuse wire which is substantially spaced from the walls of the housing completely failed to produce a fuse capable of being mass produced because the manufacturing controls necessary to keep the fuse element centered would make the manufacturing method much too difficult and costly. When only modest process controls are used, as shown in FIGS. 1-3 of the present application, the spirally wound fuse elements assume different random positions with respect to the walls of the housing, resulting in variations in the blowing current values which went beyond acceptable tolerances.

SUMMARY OF THE INVENTION

The present invention resulted form a fuse design approach completely at odds with what fuse designers previously though desirable in the design of cartridge fuses. Thus, rather than trying to design the fuse to keep the fuse element centered, an unorthodox design approach is sued. First, the spiral wound fuse element is dimensioned so that it can be easily dropped into the fuse housing oriented vertically inside one of the cup-shaped fuse end caps having molten solder therein. In this unorthodoxed approach, when the fuse is completely assembled by addition of the other end cap and soldering the fuse element thereto the blowing central portion of the fuse element is either purposely positioned off-centered, preferably by stressing it as by compression between the end caps to bow the center portion thereof, or by making the cross section of the fuse element in its uncompressed state only slightly less than the inner diameter of the fuse housing. When the other end cap is applied over the top of the vertically oriented housing, the fuse element is compressed to expand it against or near the walls of the housing. In the off-centered specie of the invention, the initial diameter of the fuse element is much smaller than the inner diameter of the fuse housing and by making it initially longer than the final inner length of the fuse housing interior, the application of the other end cap to the housing creates a bending stress on the fuse element which causes it to intentionally become bowed against or adjacent to the housing walls. In both forms of the invention, the central portions of the spiral windings of the fuse wire where fuse opening will occur most desirably touches or are immediately contiguous to the walls of the housing. The fuses can then be mass produced with modest production controls to provide fuses which open consistently within acceptable blowing tolerances because the heat sinking effects of the housing which caused variations previously in the opening time levels of the fuse vary to a much less degree than when an effort is made to center the fuse element.

The only instance known to the inventor of the subject matter of the present patent where a spirally wound wire intentionally or necessarily touches the walls of the housing is shown in U.S. Pat. No. 2,879,364. This patent discloses what is referred to as a fuse-resistor, which is an element which primarily is a resistor element that also has fusing capabilities. The present invention deals with a fuse element which is not intended to add resistance to the circuit in which it is used. Rather, it is intended to be a fusing element having an impedance which, for all practical purposes, is insignificant in comparison to the resistance of the load involved.

In the fusible resistor disclosed in U.S. Pat. No. 2,879,364, the housing is a flexible housing adapted initially to be assembled in a straight configuration, but is then bent into a U-shaped configuration. In this type of product, where the element involved is mainly a resistor and when the housing must be bent, it is expected that the spiral wound fuse element would be touching the flexible U-shaped housing in the process of forming that configuration. There is, therefore, no teaching or disclosure in this patent of positioning a spiral wound fuse element in a rigid cartridge fuse housing.

While the present invention has its most important application to slow blowing miniature fuses where reliable fuses were not heretofore mass producible at a low cost, some aspects thereof are applicable to fast blowing fuses. Thus, the present invention includes a fast or slow blowing fuse, especially a miniature fuse, where in the process of fuse assembly an initially straight fuse element is subject to stresses which cause the opening portion of the fuse to intentionally deform toward the housing wall where it is substantially off-centered and preferably contacts the housing wall.

THE FUSE EMBODIMENT OF FIGS. 1-3

Figure 1:
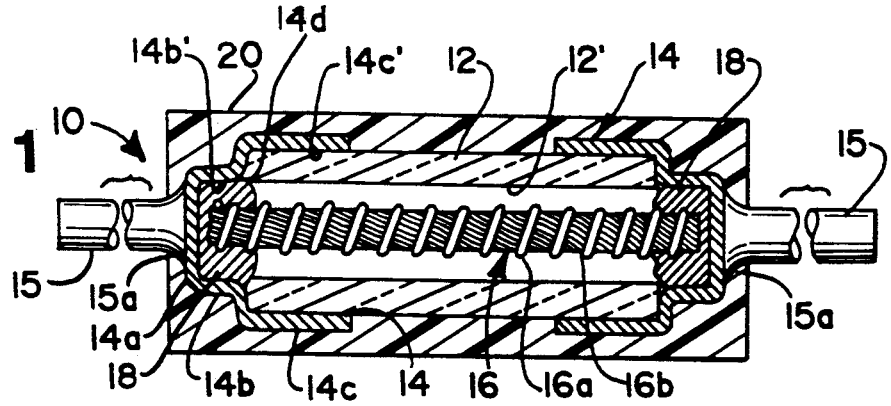
FIG. 1 is a vertical sectional view through an ideal miniature slow blowing cartridge fuse construction developed prior to the present invention, the figure being drawn as all the figures are to a greatly enlarged scale, and showing a spiral wound fuse element therein a centered position within the fuse housing.

The inventor of the subject matter of the present invention tried unsuccessfully to develop a method of mass-producing the slow blowing miniature fuse shown in FIG. 1, which is an idealized form of that fuse where the fuse element is centered in the fuse housing. Instead, the results were many defective fuses such as shown in FIGS. 2 and 3, where the fuse elements thereof sagged to different degrees, producing fuses which opened at widely differing times at the same overload current.

Figure 2:
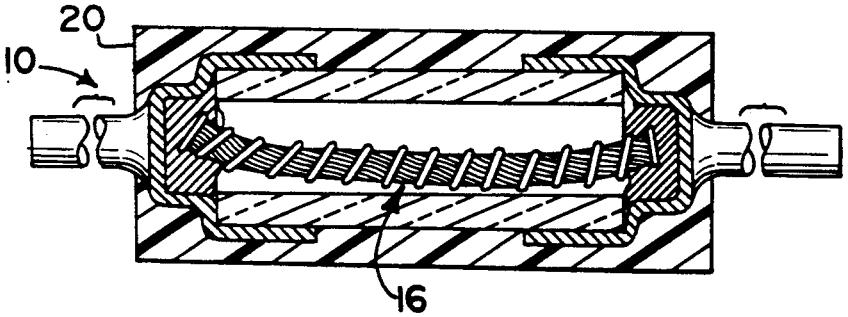
FIGS. 2 and 3 are respectively views of a fuse like that shown in FIG. 1 where the process for making the fuse has inadequate controls so that the fuse element has sagged to different degrees, causing the opening current to vary significantly from that which opens the fuse shown in FIG. 1.
Figure 3:
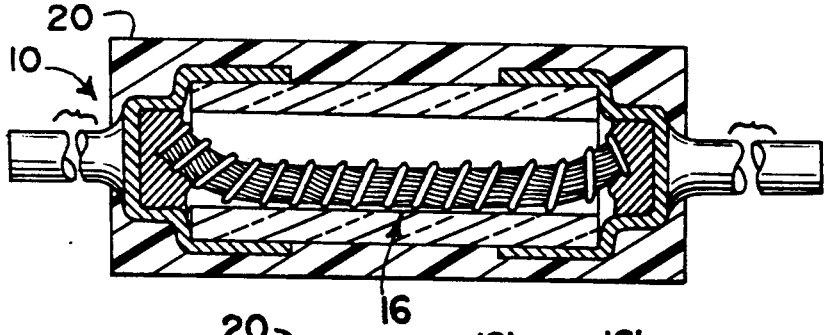

The fuses shown in FIGS. 1-3 are identified by reference 10. They each include an open-ended cylindrical housing 12 which may be made of glass or other suitable insulating material. It defines a cylindrical fuse element-containing space 12' therein. The open ends of the housing 12 are closed by cup-shaped metal end caps 14—14. Welded or otherwise secured to the end caps are outwardly axially extending leads 15—15 which join the end caps at lead enlargements 15*a*—15*a*. A spiral wound fuse element 16 physically extends between the end caps 14—14 where it is electrically and physically connected thereto by bodies of solder 18—18. Following conventional design technique, the inventor tried to fabricate the fuses 10 so that the spiral fuse elements 16 thereof were perfectly centered within the housing 12, so that they are spaced an equal maximum distance from the walls of the housing 12. However, unless very close, difficult to provide controls over the assembly process are utilized, frequently the fuse elements sagged to different degrees, as shown respectively in FIGS. 2 and 3. Because the heat dissipation characteristics of the fuses shown in FIGS. 1-3 are obviously different, the blowing current values of the fuse elements thereof undesirably varied from the tolerances permitted by the fuse quality standards used in the industry.

To increase the strength of the fuse and to seal the fuse from external environments of all kinds, including liquid printed circuit board cleaning chemicals, an outer encapsulation layer 20 is applied by molding or other techniques, as, for example, disclosed in U.S. Pat. No. 4,460,887, which seals the fuse against ingress of such chemicals to the end caps 14—14.

FUSE EMBODIMENTS OF FIGS. 4 AND 5

As previously indicated, the present invention deals with an unorthodoxed design approach for mounting a spiral wound fuse element in the fuse housing. Two forms of the fuses 10' and 10" of the invention are shown respectively in FIGS. 4 and 5. These fuses 10' and 10" differ from the fuse 10 in the positioning and, in the case of the fuse of FIG. 5, in the size of the fuse element involved. The corresponding elements are identified by identical reference numerals. These unique fuse designs also make practical the mass production of fuses having consistent blowing characteristics.

The spiral wound fuse elements 16' and 16" in the fuses 10' and 10" are manufactured preferably in the manner disclosed in U.S. Pat. No. 4,409,729. Thus, the fuse element 16' and 16" comprise a suitable fuse wire 16*a*' or 16*a*" spirally wound around a core 16*b*' or 16*b*" of insulating material preferably comprising twisted strands of ceramic yarn manufactured by the 3M Company of St. Paul, Minn. This ceramic fiber yarn is both compressible, expandable and resilient. In the fuse 10 shown in FIG. 2, the spiral wound fuse element 16 can uncontrollably sag to different degrees in the assembly process for reasons including the fact that the fuse element 16 is not compressed between the end caps 14—14. In contrast, the fuse element 16' of the fuse 10' in FIG. 4, while similarly much smaller than the inner diameter of housing 12, is controllably bowed by being compressed between the end caps, where it most desirably contacts the housing walls.

Figure 4:
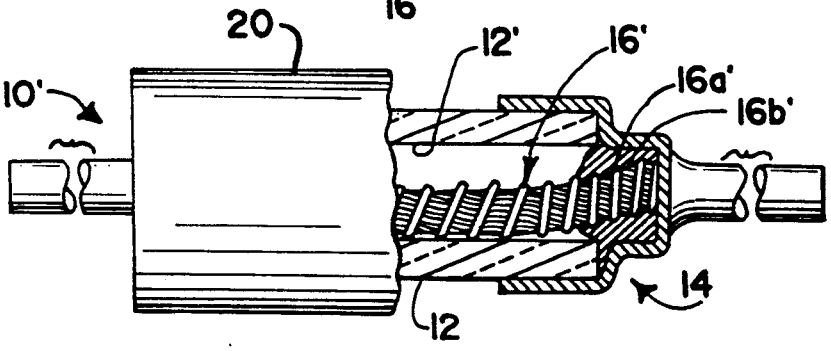
FIG. 4 is a vertical sectional view of one form of a slow blowing fuse of the invention where the fuse element is a spiral wound fuse element much smaller than the housing interior and which is bowed against the housing walls by compressing the fuse element between the end caps of the fuse.
Figure 5:
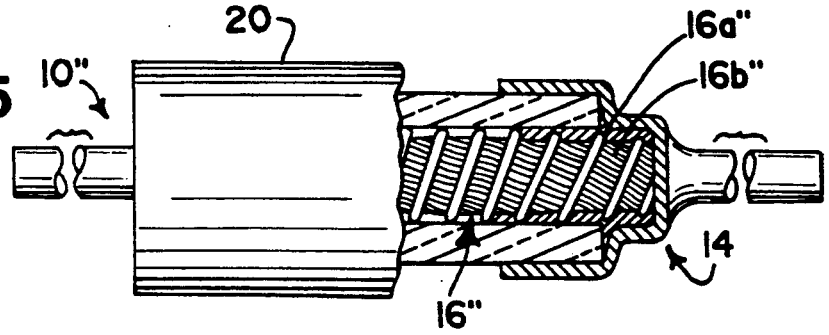
FIG. 5 is a vertical sectional view of another form of slow blowing fuse of the invention where the fuse element is a spiral wound fuse element which in its uncompressed state is only slightly smaller than the housing interior and is expanded into contact therewith by its compression by the end caps of the fuse.

The fuse 10' shown in FIG. 5 differs from both the fuses 10 and 10' of FIGS. 2 and 4 in that the spiral wound fuse element 16" thereof, before it is compressed between the end cap is slightly smaller than the inner diameter of the housing 12. When it is compressed between the end caps, except for the outer end portions of the spiral wound fuse element which is kept from fully expanding because of the presence of the solder 18—18, it expands equally in all directions preferably into contact with the walls of the housing.

METHOD OF MAKING THE FUSE EMBODIMENT OF FIG. 4 SHOWN IN FIGS. 6 AND 7

Figure 6:
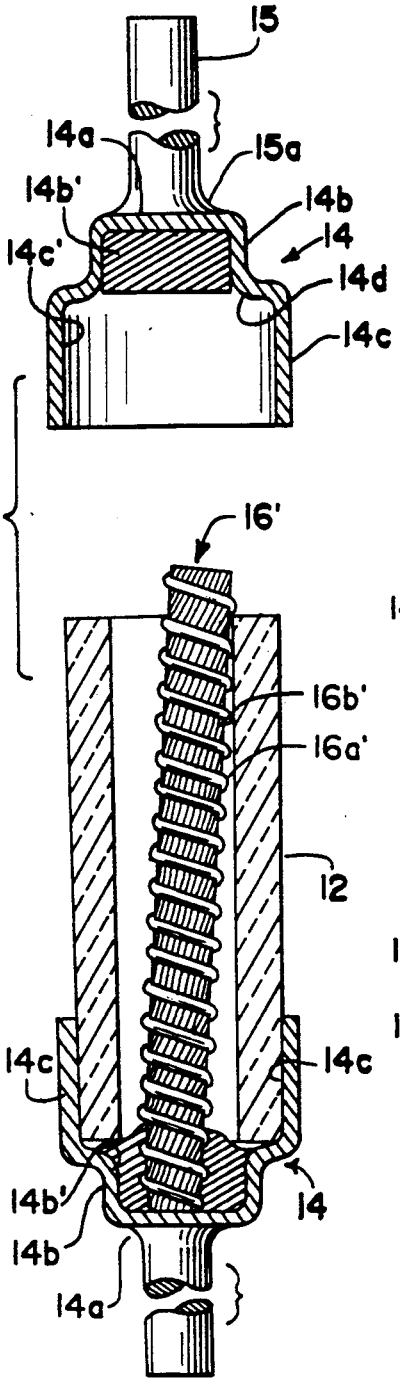
FIG. 6 is a vertical, sectional view illustrating a first step in the manufacture of the miniature fuses shown in FIG. 4, where the spiral wound fuse element of much smaller size than the housing interior is dropped into the bottom of the open top of a vertically oriented housing received in the open upper end of a bottom cup-shaped end cap, and showing also an upper cup-shaped end cap positioned to be applied over the fuse element to compress and encircle the top of the housing involved.
Figure 7:
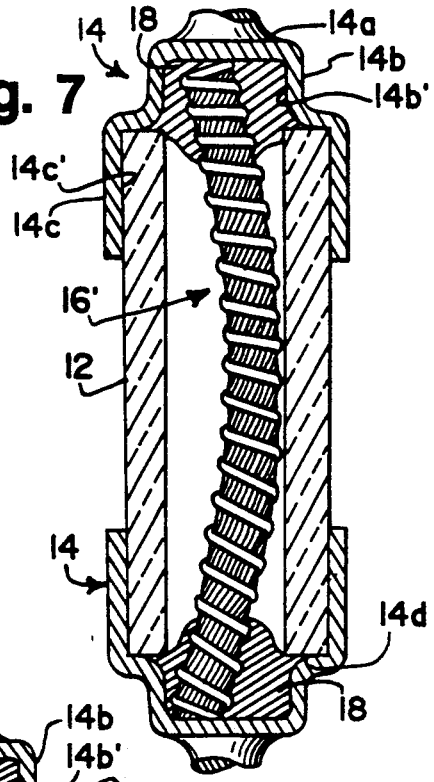
FIG. 7 is a view corresponding to FIG. 6 after the upper end cap has been pressed down into position over the outside of the housing, the compression of the fuse filament causing it to bow to one side of the housing where it makes contact with the housing walls.

Refer now to FIGS. 6 and 7 which show two steps in the assembly of the fuse 10' shown in FIG. 4. Before describing this method, some additional description of the configuration of the preferred end caps 14—14 would be helpful in the understanding of the assembly procedure. First of all, each of the end caps 14 preferably comprise a relatively small outer cup-shaped end cap portion formed by an end wall 14*a* and a cylindrical side wall 14*b* extending axially inwardly therefrom. The outer cup-shaped portion joins a larger inner cup-shaped portion through a shoulder-forming transitional wall 14*d*. The larger cup-shaped portion is formed by a cylindrical wall 14*c*. The smaller cylindrical wall 14*b* defines a solder-receiving well 14*b*' which is of a size to receive a solder pellet 18 and the end of the spiral wound fuse element 16', and the larger cylindrical wall 14*c* defines a housing-receiving recess 14*c*' which closely receives the adjacent end of the housing which bears on the shoulder-forming wall 14*d*.

The first step in assembly is to support the end cap 14 having a melted solder pellet 18 therein by a suitable fixture forming part of a moving conveyor (not shown) so its open end faces upwardly. This end cap is delivered to a housing-applying station along the conveyor where one end of a vertically oriented housing 12 is dropped into the housing recess 14*c*'.

At the next station along the conveyor, a vertically oriented spiral wound fuse element 16' is dropped into the upwardly facing open end of the housing 12. The bottom end of the spiral wound fuse element will generally come to rest upon the inner wall 14*a* of the end cap 14 as it drops through and displaces the molten body of solder. The upper end of the corrugated fuse wire element 16' will then project above the open top of the housing 12. FIG. 6 shows the other cup-shaped end cap 14 with its open end facing downwardly in a position to be pushed down upon the upper end of the spiral wound fuse element 16' and around the housing 12 at the next station along the conveyor. The latter end cap 14 then presses down upon the spiral wound fuse element 16' to cause it to bow toward and preferably against the housing wall, as shown in FIG. 7. The latter end cap 14, which is preferably identical to the bottom end cap 14, also initially has a solid solder pellet 18 in its solder-receiving well 14*b*'. Preferably just prior to the application of the upper end cap 14 over the housing 12, the solder pellet 18 therein is heated to melt the same. Because of the small space within the end cap and housing, the surface tension and consistency of the melted solder will prevent the solder from dropping from the end cap.

The shoulder-forming transition wall 14*d* of each end cap is curved and thus forms a fuse element centering wall which assures the placement of the ends of the fuse element into the solder-receiving wells of the end caps 14—14 when the fuse element is finally compressed between the end caps. When the solder bodies 18—18 solidify, the resulting fuse structure securely anchors the fuse element 16' in place within the housing 12. The thus assembled fuse is then delivered to a suitable encapsulation layer-applying station, where the encapsulation layer 20 is applied thereto in any suitable way.

METHOD OF MAKING THE FUSE EMBODIMENTS OF FIG. 5 SHOWN IN FIGS. 8 AND 9

Figure 8:
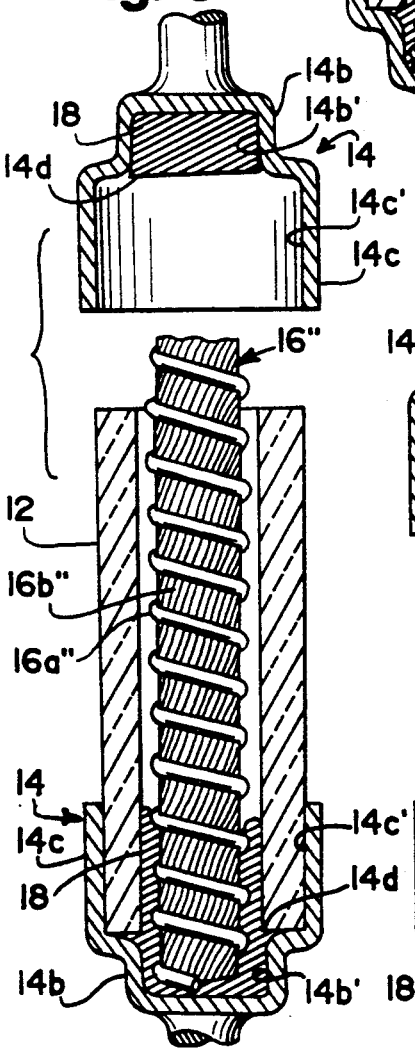
FIG. 8 is a vertical sectional view like FIG. 6 but showing the first step in the manufacture of the fuse shown in FIG. 5, where the fuse element is of much greater diameter than that of the embodiment shown in FIG. 4, so that compression thereof will expand at least the central portions thereof in all directions into contact with the housing walls.
Figure 9:
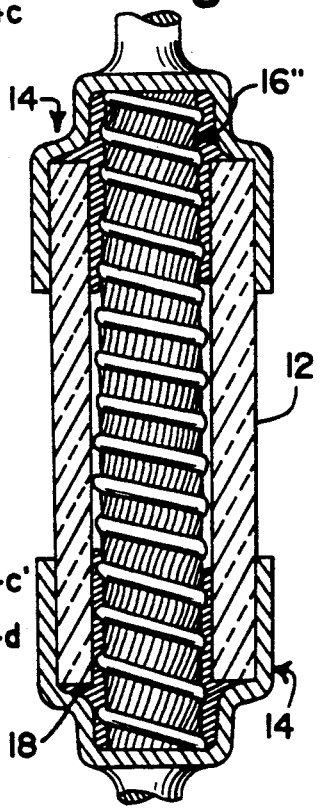
FIG. 9 is a view of the next step in the assembly of the fuse shown in FIG. 5 where the upper end cap is applied over the housing end to compress the fuse element and complete assembly of the basic fuse except for application of an encapsulation layer.

Refer now to FIGS. 8 and 9 which illustrate how the fuse shown in FIG. 5 is most advantageously assembled. Except for the size of the spiral wound fuse element 16" shown therein, the rest of the fuse structure and the sequence of assembly is identical to that just described in connection with FIGS. 6 and 7. Here, however, because the spiral wound fuse element 16" is only slightly smaller than the inner diameter of the housing 12 and the similarly sized solder-receiving well 14*b*', the force supplied by the application of the upper end cap 14 around the open end of the housing 12 will not cause a substantial bowing of the fuse element thereof. Rather, it will cause a progressive expansion of the center portion thereof in all directions, where the fuse wire becomes pressed against the housing walls, as shown in FIG. 9. The displaced solder flows around and into the small spaces between the successive fuse wire windings at the outer end portions of the fuse element, preventing those portions from expanding into contact with the housing wall. The center portion of the fuse wire element expands in all directions into contact or close proximity with the housing wall.

It should be noted that the interior dimensions of the solder-receiving wells 14*b*'—14*b*' of the end caps 14—14 are approximately the same as the uncompressed diameter of the spiral wound fuse element 16". Accordingly, when ends of the fuse element 16" are fully inserted into the wells 14*b*'—14*b*', the melted solder originally therein is displaced into the adjacent spaces between the housing 12 and the fuse element core 16*b*" to prevent the expansion of the outer end portions of the fuse element 16". The only portion of the spiral wound fuse element which will then expand and engage the inner walls of the housing is the center section thereof.

After the assembly step shown in FIG. 9, the fuse is applied to a encapsulation-applying station as previously described in the manufacture of the fuse 10' shown in FIGS. 6 and 7.

EXEMPLARY SPECIFICATIONS

A exemplary specification for a 1 amp fuse like that shown in FIG. 5 is as follows.

Housing Specifications:

Housing Material—Glass
Inner Diameter—0.048
Outer Diameter—0.072
Length—0.160

Supplier— Basic Glass Products, Lone Grove, Okla. 73443

Solder Specifications

Solder Material—92.5% lead, 5% tin and 2.5% silver

Supplier and Order Number— Alpha Metals, Inc., P.O. Box 600 T—Route 440 Jersey City, N.J. 07304

Fuse Wire Specifications

Fuse Wire Material—Tin plated copper

Supplier— Molecu Wire Corporation, P.O. Box 495-T, Farmingdale, N.J. 07727

Number of Turns—142 turns/in.

Uncompressed Length—0.197 in.

Fuse Wire Core Specifications

Core Material—Ceramic yarn

Supplier and Order Number— 3M Company, 3M Center, St. Paul, Minn. 55144

End Caps

Supplier: Stewart Stamping Corp., Yonkers, N.Y. 10704

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. In a slow blowing fuse including an open-ended rigid housing having all means defining a fuse element-containing space therein, conductive end caps closing off the ends of the housing and acting as electric terminals for the fuse, and a spiral wound fuse element in said space extending between and electrically connected to said end caps, said spiral wound fuse element comprising a core of flexible material around which is spirally wound a fuse filament which is electrically connected to the end caps, the improvement wherein said spiral wound fuse element is sandwiched and compressed between the end caps to provide a configuration where at least a central portion thereof is located adjacent the housing wall means.

2. The slow blowing fuse of claim 1 wherein said fuse element has a thickness much less than the cross section of said fuse element-containing space of said housing and wherein the force of said end caps on said fuse element causes the same to bow toward the housing wall means.

3. The slow blowing fuse of claim 1 wherein said fuse element in its uncompressed state has a thickness slightly smaller than the cross section of said fuse element-containing space of said housing and wherein the end caps apply an axial compression force on said fuse element which causes at least the central portion thereof to bulge outwardly in all directions to make contact with the housing.

4. The fuse of claim 3 wherein said end caps are cup-shaped to extend around the outside of the open ends of said housing, each end cap defines a relatively small outer well substantially filled by the ends of said fuse element, and a larger recess located axially inwardly of said well which receives the adjacent end of the fuse housing.

5. The fuse of claim 4 wherein there is solder surrounding the end portions of said fuse element outside of said well where the fuse filament and core are spaced from the housing wall means, a central portion of said fuse filament contacting the housing wall means.

6. In a miniature fuse including an open-ended rigid housing having wall means defining a fuse element-containing space therein, conductive end caps closing off the ends of the housing and acting as electric terminals for the fuse, and a fuse element in said space electrically connected to said end caps, the improvement wherein said fuse element is stressed to bow a central portion thereof toward the housing wall means where it is adjacent thereto.

7. The fuse of claims 1 or 6 wherein aid fuse element touches the housing wall means.

8. The fuse of claims 1, 2, 3, or 6 wherein the cross section of said fuse element containing space of said housing in a direction transverse to the longitudinal axis of said housing is no greater than about 0.075".

9. The method of making a miniature fuse having a substantially rigid, initially open-ended housing having wall means defining a fuse element-containing space therein longitudinally extending between the opposite ends thereof, conductive electric terminal-forming, cup-shaped end caps encircling the opposite longitudinal ends of said housing, and a fuse element extending within said fuse element-containing space and electrically connected to said end caps, the method comprising the steps of:

vertically orienting said open-ended housing and placing the bottom thereof within the open end of one of said cup-shaped end caps oriented with its open end facing upward and at least partially filled with a body of solder, providing a fuse element of a configuration and size to be readily dropped into the open top of said vertically oriented housing and when fully inserted therein so it extends fully down into said end cap and into a molten body of said solder to be solidified it projects above the top of said housing a sufficient amount that when the other end cap is applied over the end of the housing it will press down upon the fuse element;

vertically orienting said fuse element and dropping it into the open top of said housing where the bottom end of the fuse element passes into the end cap;

applying the open-end of the other cup-shaped end cap over the top of the housing, said other end cap having solder therein which is rendered molten and, because of surface tension and the dimension of the housing interior will not run down fully into the housing, and pressing said other end cap down upon the housing so as to compress the fuse element therein and cause it to move down into the body of molten solder and assume a shape where it is adjacent the housing wall means; and solidifying the solder while maintaining the downward force on said other end cap.

10. The method of claim 9 wherein said fuse element has a thickness much less than the corresponding dimension of said fuse element-containing space of said housing, so that the application of said other end cap causes the compressed fuse element to bow towards the housing wall means.

11. The method of making the fuse of claim 9 wherein said element is a spiral wound fuse element which in its uncompressed state has a thickness slightly less than the cross section of said fuse element-containing space of said housing wherein the compression of said fuse element causes at least the central portions thereof to bulge outwardly.

12. The method of making the fuse of claims 9, 10 or 11 wherein the cross section of said fuse element-containing space in the direction transverse to the longitudinal axis of said housing is no greater than about 0.075".

* * * * *

UNITED STATES PATENT AND TRADEMARK OFFICE

CERTIFICATE OF CORRECTION

PATENT NO. : 5,142,262

DATED : August 25, 1992

INVENTOR(S) : Daniel Onken

It is certified that error appears in the above-indentified patent and that said Letters Patent is hereby corrected as shown below:

Column 7, line 38, Claim 1, delete "all" and insert --wall--.

Column 8, line 18, Claim 7, delete "aid" and insert --said--.

Signed and Sealed this

Sixteenth Day of July, 1996

Bruce Lehman

*Attest:*

BRUCE LEHMAN

*Attesting Officer*

*Commissioner of Patents and Trademarks*